US009914045B1

(12) United States Patent
Lambert et al.

(10) Patent No.: US 9,914,045 B1
(45) Date of Patent: Mar. 13, 2018

(54) HIGH ROLL DICE CASINO TABLE GAME

(71) Applicant: Global Innovative Gaming, LLC, Allentown, PA (US)

(72) Inventors: Kerry J. Lambert, Breinigsville, PA (US); Norman G. Berkowitz, Slatington, PA (US)

(73) Assignee: Global Innovative Gaming, LLC, Allentown, PA (US)

( * ) Notice: Subject to any disclaimer, the term of this patent is extended or adjusted under 35 U.S.C. 154(b) by 0 days.

(21) Appl. No.: 14/660,617

(22) Filed: Mar. 17, 2015

Related U.S. Application Data

(63) Continuation-in-part of application No. 13/048,845, filed on Mar. 15, 2011, now abandoned.

(60) Provisional application No. 61/314,021, filed on Mar. 15, 2010.

(51) Int. Cl.
*A63F 9/04* (2006.01)
*A63F 3/00* (2006.01)

(52) U.S. Cl.
CPC ..... *A63F 3/00157* (2013.01); *A63F 9/0402* (2013.01); *A63F 2003/0017* (2013.01); *A63F 2003/00164* (2013.01); *A63F 2003/00167* (2013.01)

(58) Field of Classification Search
CPC ..... A63F 9/04
USPC ..... 273/146, 274; 463/16, 22
See application file for complete search history.

(56) References Cited

U.S. PATENT DOCUMENTS 3,747,935 A * 7/1973 Engelbrecht ..... A63F 9/0402 220/6
4,469,329 A * 9/1984 Guyer ..... A63F 9/0406 273/146
4,648,602 A * 3/1987 Maroney ..... A63F 9/0402 273/146
4,685,672 A * 8/1987 Fillers ..... A63F 9/00 273/459
5,364,101 A * 11/1994 Spooner ..... A63F 9/0413 273/146
5,413,351 A * 5/1995 Franklin ..... G07F 17/32 273/274
5,513,850 A * 5/1996 Vancura ..... A63F 3/00157 273/274
5,513,851 A * 5/1996 Harris ..... A63F 3/00157 273/274
5,649,704 A * 7/1997 Dobbin ..... A63F 9/0402 273/146

(Continued)

*Primary Examiner* — William Pierce
(74) *Attorney, Agent, or Firm* — Clinton H. Wilkinson; Charles A. Wilkinson

(57) ABSTRACT

A casino table game and method of play using between eight and twelve dice, which game is played on a game surface including a dice throw box, a first roll wagering area for wagering on the highest ranking and greatest number of like kind indicia dice resulting from a first dice roll, a first and second roll wagering area for wagering on the actual number of like kind indicia dice that will result from the first dice roll or a first and second dice roll, a large payout wagering area for wagering that most or all of the dice will result with the same indicia face up, and a second roll wagering spot for the players to pay an ante in order to be eligible to wager on the results of a second dice roll, which game provides exciting play with the additional possibility of winning a jackpot or lottery-sized payout.

10 Claims, 5 Drawing Sheets

(56) References Cited

U.S. PATENT DOCUMENTS 5,788,239 A * 8/1998 Kong ..... A63F 3/00157 273/274
5,791,651 A * 8/1998 Bryant ..... A63F 3/00157 273/146
6,123,335 A * 9/2000 Adkins ..... A63F 3/00157 273/274
6,209,874 B1 * 4/2001 Jones ..... A63F 9/04 273/146
6,336,633 B1 * 1/2002 Webb ..... G07F 17/3244 273/146
6,378,869 B1 * 4/2002 Hedge, Jr. ..... A63F 3/00157 273/146
6,422,563 B1 * 7/2002 Fairchild ..... A63F 3/00157 273/274
6,431,546 B1 * 8/2002 Keller ..... A63F 3/00157 273/146
6,508,469 B2 * 1/2003 Promutico ..... A63F 3/00157 273/146
6,601,848 B1 * 8/2003 Timmons, Sr. ..... A63F 9/04 273/146
6,656,047 B1 * 12/2003 Tarantino ..... A63F 3/00157 273/146
6,752,393 B2 * 6/2004 DiGirolamo ..... A63F 9/18 273/268
7,080,838 B2 * 7/2006 Cohen ..... A63F 3/00157 273/146
7,152,863 B2 * 12/2006 Scheb, Jr. ..... A63F 3/00157 273/146
7,380,792 B2 * 6/2008 Taranino ..... A63F 9/20 273/146
7,694,969 B2 * 4/2010 Abrahamson ..... A63F 3/00157 273/247
8,276,915 B2 * 10/2012 Berkowitz ..... A63F 9/04 273/146
8,333,380 B2 * 12/2012 Berkowitz ..... A63F 3/0665 273/139
2005/0035549 A1 * 2/2005 Zeng ..... A63F 1/04 273/292
2005/0146092 A1 * 7/2005 Knight ..... A63F 3/00157 273/145 R
2009/0156294 A1 * 6/2009 Berkowitz ..... G07F 17/3244 463/20
2010/0252991 A1 * 10/2010 McGrath ..... A63F 9/04 273/146
2013/0084936 A1 * 4/2013 Pease ..... G07F 17/32 463/18

* cited by examiner

HIGH ROLL DICE
Rolling for Millions
HIGH ROLL DICE
Rolling for Millions
HIGH ROLL DICE
TWO
THREE
FOUR
FIVE
SIX
ACE
$1,000,000
10
10
10

| | 1ST ROLL | 2ND ROLL |
|---|---|---|
| 2 OF A KIND | 10 TO 1 | - |
| 3 OF A KIND | 4 TO 5 | 4 TO 1 |
| 4 OF A KIND | 2 TO 1 | 1 TO 1 |
| 5 OF A KIND | 10 TO 1 | 2 TO 1 |
| 6 OF A KIND | 50 TO 1 | 5 TO 1 |
| 7 OF A KIND | 200 TO 1 | 20 TO 1 |
| 8 OF A KIND | 1000 TO 1 | 100 TO 1 |
| 9 OF A KIND | 2000 TO 1 | 1000 TO 1 |

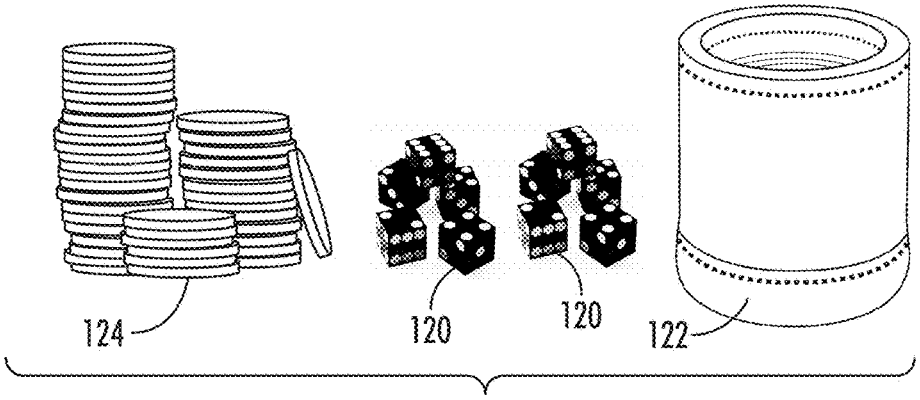
FIG. 4
FIG. 5
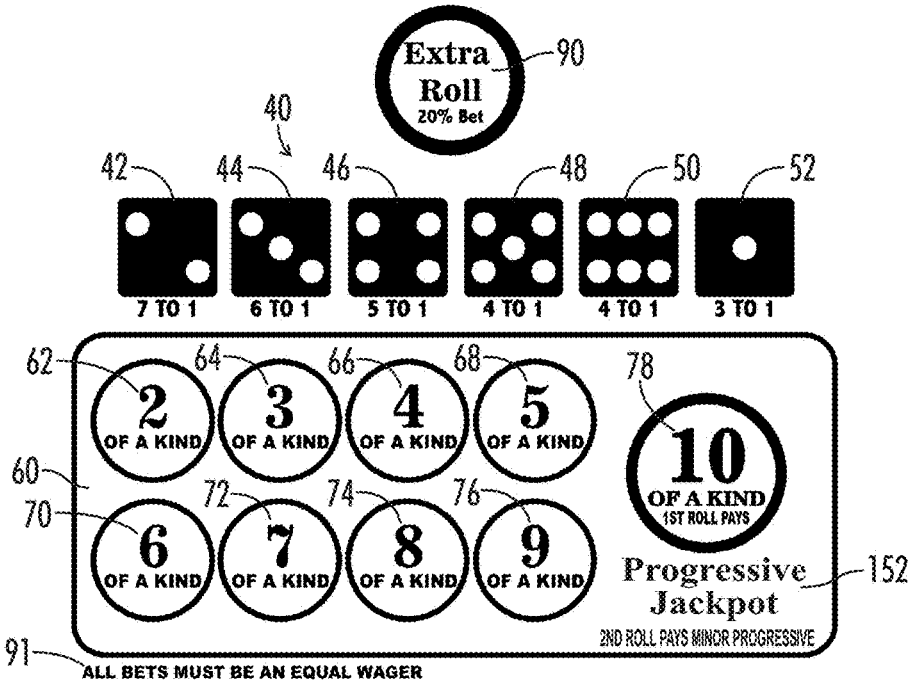
212
| | 1ST ROLL | 2ND ROLL |
|---|---|---|
| 2 OF A KIND | 10 TO 1 | - |
| 3 OF A KIND | 4 TO 5 | 4 TO 1 |
| 4 OF A KIND | 2 TO 1 | 1 TO 1 |
| 5 OF A KIND | 10 TO 1 84 | 2 TO 1 86 |
| 6 OF A KIND | 50 TO 1 | 5 TO 1 |
| 7 OF A KIND | 200 TO 1 | 20 TO 1 |
| 8 OF A KIND | 1000 TO 1 | 100 TO 1 |
| 9 OF A KIND | Pays Mini-Progressive | 1000 TO 1 |

HIGH ROLL DICE CASINO TABLE GAME

CROSS REFERENCE TO RELATED APPLICATIONS

This application claims priority to and the benefit of U.S. utility patent application Ser. No. 13/048,845 filed on Mar. 15, 2011, which claims the benefit of U.S. provisional patent application Ser. No. 61/314,021 filed on Mar. 15, 2010, the disclosures of which are incorporated herein by reference.

BACKGROUND OF THE INVENTION

1. Field of the Invention

The present invention relates generally to wagering games and methods of game play, and more particularly to a casino table game wherein wagers are placed on the results of a first roll of a plurality of dice, and on the results of a second roll of a number of said plurality of dice, which number is determined by the outcome of the first roll, and wherein the wagers are based on the number of occurrences of the highest ranking like kind indicia dice resulting from such rolls.

2. Preliminary Discussion and Description of Related Art

Various casino style games that employ the use of dice and casino chips or tokens and where one or more players place wagers on the outcome of a dice roll are known in the prior art. In the game of craps, for example, players place wagers on the outcome of a roll or series of rolls of a pair of dice in betting zones on a game table. The rules of craps are complex and difficult to master, however, and overall such game is not very attractive to recreational or novice players.

Attempts have therefore been made to create new dice games having games rules that are easier for players to learn and follow, which also presumably make the game more attractive to both novice and experienced gamblers. As an example, U.S. Pat. No. 5,308,081 issued to R. Bartle discloses a method of playing a betting game which is played with three dice. Bets are made in three betting zones, including a singles betting zone where the players bet on what number will be rolled by a first dice roll, and a second betting zone where the players bet that the number rolled in a second roll will equal the number rolled in the first roll. Bets can also be placed on the cumulative number of the three dice rolled.

One of the enticing features of slot machine games, particularly progressive-type games, is that in every game players have the opportunity to win a large payout. A drawback of known dice table games, however, is that they do not afford players the chance to win large payouts. Mathematically, the odds of a player correctly predicting the outcome of a roll of one, two, or three dice, either thrown together in a single roll or consecutively, are too high to justify a sufficiently large payout for the game to attract large numbers of customers away from other games. Recent attempts to market new dice games have also been unsuccessful because the games are slight variations of known games, there is a lack of action or excitement, or the mode of play is not sufficiently entertaining for players to make repeat visits to a casino to play such game.

Eliot Jacobson, Ph.D., of Jacobson Gaming, has espoused ten (10) principles for successful game design, development & selection, which are repeated below.

1. Simplicity: The idea of a new game should be explainable to a person of average intelligence in less than a minute.
2. Limit side bets: At most, there should be but one side bet.
3. Table layout: The layout should be simple and natural to use.
4. House Edge: The game should have a house edge consistent with the edge of other games in its category. Successful games often integrate both the small frequent win with the large, rare payout.
5. Name of the Game: The name should be simple and descriptive with no extra words.
6. Use established elements: The game should not involve new physical elements; cards or dice are enough.
7. Entertainment value: The game should be fast-paced, interactive and fun to play.
8. Simple Game Rules: The game should be easy for the staff, management, and security to learn.
9. Bullet Tested: The game must be tested against advantage play.
10. Casino Win: The game must make more money than the one it replaces.

The present game meets all of these principles. When compared to highly successful games such as "Craps", the "High Roll Dice" table game of the present invention is simpler to learn and play (4 levels of bets vs. 40 in craps), has faster to hand-completion (2 rolls vs. average 3.4), is more user-friendly (simplicity of table layout and simplicity of betting), the house edge is consistent with craps, the same physical elements (dice) as craps are involved, the game combines frequent small wins with rare large payout (for example, up to $1 million on 10 of a kind), and has lower operational costs (more profits than craps). Many players, including some women, who now comprise more than fifty percent of casino players, are intimidated by the complexity of craps betting and the unique language that craps play has adopted (e.g. "snake eyes"). Further, provision of a casino table wagering game in which preferably between 8 and 12 dice are rolled simultaneously, and in which on every roll players have a chance to win small amounts as well as a jackpot payout of, in one embodiment, one million dollars or more, has not been contemplated. The present game is simple, fun, fast-paced, and offers a possible jackpot that if won would change the player's lifestyle in the same fashion as a lottery winner.

OBJECTS OF THE INVENTION

It is therefore an object of the present invention to provide a casino dice game and method of play that is easy to learn and fun to play for players of all skill levels.

It is a further object of the present invention to provide a casino dice game and method of play that provides players with multiple opportunities to win frequently and to win large payout amounts.

It is a further object of the present invention to provide a casino table game and method of play where in each play players have the opportunity to win a large payout such as, in one embodiment, up to one million dollars, by placing a single bet.

It is a still further object of the present invention to provide a casino dice game and method of play that combines a table game atmosphere with potential payouts rivaling instant win lottery games.

It is a still further object of an embodiment of the invention to provide a casino table game and method of play in which a plurality of dice, preferably ten, are rolled simultaneously in a first roll, after which the outcome of the roll is analyzed to determine the highest ranking and highest number of like indicia dice resulting from the roll, which dice are removed from game play, and then depending upon the wagers made by the players a second dice roll of the remaining dice may be made, whereby players have the opportunity to place multiple bets or wagers on the outcome of each roll, including a lottery size or progressive jackpot.

It is a still further object of an embodiment of the invention to provide a casino table game and method of play in which during a first dice roll players have the opportunity to place wagers or bets in separate playing zones, according to the highest ranking dice indicia landing face up the greatest number of times, and the actual number of occurrences of such dice indicia, and in a second roll according to the number of additional occurrences of such dice indicia resulting from the second roll.

It is a still further object of the invention to provide a casino table game and method of play in which players place bets on the outcome of a first dice roll, and have the opportunity to purchase the right to place bets on the outcome of a second dice roll.

Still other objects and advantages of the invention will become clear upon review of the following detailed description in conjunction with the appended drawings.

SUMMARY OF THE INVENTION

A wagering game for casinos and other wagering institutions is provided. In one embodiment, the game includes a game table having a unique table layout, and is played using a plurality of game tokens or chips, a set of dice preferably numbering between eight and twelve, a dice throw box, and a dice cup. During game play, in most games at least some of the dice will rolled two separate times. In the first or initial roll of the plurality of dice, all of the dice are rolled or thrown simultaneously, while in the second roll, the number of dice rolled depends upon the results of the first roll. The object of the game in the first or initial roll of the plurality of dice is for players to correctly match or predict which dice indicia having the highest ranking or priority indicia will result landing face up the greatest number of times in such first roll. Wagers or bets are made by each player in separate player stations on the table layout by placing one or more game tokens having a total value at least equal to the table or game wagering minimum on at least one wagering spot. In one embodiment, wagers or bets can be made on which of the dice indicia having the highest ranking or priority indicia will land face up the greatest number of times in the first roll. In addition, separate wagers or bets can be made on the actual number of occurrences of such highest ranking or priority dice indicia will occur in the first roll. Players can also "purchase" an extra roll by paying an ante, pursuant to which the same or separate wagers or bets can be placed on the predicted results of a second dice roll, i.e., that a predicted number of additional occurrences of the highest ranking or priority dice indicia resulting from the first roll will occur in the second roll, such that the total or combined number of occurrences of the highest ranking or priority dice indicia in the first and second rolls equal the player's prediction.

In one embodiment, the game is played on a table which is preferably similar in appearance to a conventional "blackjack" style table, having a table top skin made of felt or a felt-like material. The top surface of the table is inscribed with a plurality of player stations and a dealer station. Each player station includes several different wagering or betting zones containing at least one wagering spot. Bets are made by placing game tokens on the wagering spots. A first wagering or betting zone includes a plurality of wagering spots each having thereon an indicia which is representative of the indicia on one of the dice surfaces. Thus, where standard six-sided dice are used, the first wagering zone will contain a sufficient number of individual wagering spots so that at least one wagering spot in the first zone has a separate indicia of one through six pips thereon, respectively. In one embodiment, the first wagering zone may be considered the primary wagering zone, where wagering is mandatory, and is the zone in which bets on which dice indicia having the greatest number of occurrences and the highest indicia priority will result from the first or initial dice roll are placed. In another embodiment, wagering in the first wagering zone is optional.

A second wagering zone in each player station also includes a plurality of wagering spots, having indicia or wording such as "Two Of A Kind" or "Eight Of A Kind" imprinted on each spot, respectively. In the second wagering zone, players place wagers or bets on what the actual number of occurrences of the highest ranking or priority indicia will be in the first roll, or if the for a second roll is paid, also for the combined number in a first and second roll. In an embodiment where the game is played with ten dice, the second wagering zone includes nine wagering spots having indicia such as "Two Of A Kind" through "Ten Of A Kind" on the wagering spots. In another embodiment, the second wagering zone includes seven wagering spots having indicia such as "Two Of A Kind" through "Eight Of A Kind" on the wagering spots.

In various embodiments, a third wagering zone is provided, which in one embodiment includes a single wagering spot whereby a player by placing a chip or token on such spot prior to the first dice roll can purchase the opportunity or pay the ante to place wagers or bets on the outcome of the second dice roll. The second roll includes those dice that were not part of the group of "High Roll" dice in the first roll occurring the greatest number of times with the highest ranking or priority indicia, which "High Roll" dice are removed from play prior to the second roll. In one embodiment, players must pay the ante for the second roll at the beginning of the game, or prior to the first roll. If a bet in the second wagering zone is made and it turns out that the actual number of occurrences of the highest priority indicia in the first roll is less than the predicted number of occurrences, then the second roll bet is valid. However, if the actual number of occurrences of the highest priority indicia in the first roll is more than the predicted number of occurrences, the second roll bet is moot. In another embodiment, one or more of the wagering spots in the second wagering zone, typically those labelled "Nine Of A Kind" and "Ten Of A Kind" are grouped to form a separate wagering zone in which such wagering spots are utilized as a side bet area.

A unique feature of present game is the opportunity to make a "high stakes" bet on each turn or roll. In one embodiment, a high stakes bet can be made in the second wagering zone by placing a token on the "Nine Of A Kind" or "Ten Of A Kind" wagering spot. In another embodiment, a high stakes bet can be made by placing a bet in a side bet wagering area, for which side bet there is a large payout such as up to one million dollars, or in an alternative embodiment a progressive jackpot. Indicia describing the game, such as "High Roll Dice", the odds of winning for each wagering spot, or other appropriate sayings, slogans, advertisements, logos, trademarks, etc. may also be imprinted on the table. The house wins all losing bets made, as well as all second or "extra roll" bets or purchases made.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will form the subject matter of the claims appended hereto. In this respect, before explaining the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception upon which this disclosure is based may readily be utilized as a basis for designing other systems and methods for carrying out the several purposes of the present invention. It is important, therefore, that the claims be regarded as including such equivalent constructions insofar as they do not depart from the spirit and scope of the present invention.

BRIEF DESCRIPTION OF THE APPENDED DRAWINGS

FIG. 4 illustrates several accessories used during play of the table game of the present invention.

FIG. 5 is a close-up view of an alternative player station for use with the game table of the present invention.

DETAILED DESCRIPTION OF THE PREFERRED EMBODIMENTS

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention. Wherever possible, like reference numbers have been utilized to refer to like elements or features of the invention throughout the different embodiments illustrated herein.

Figure 1:
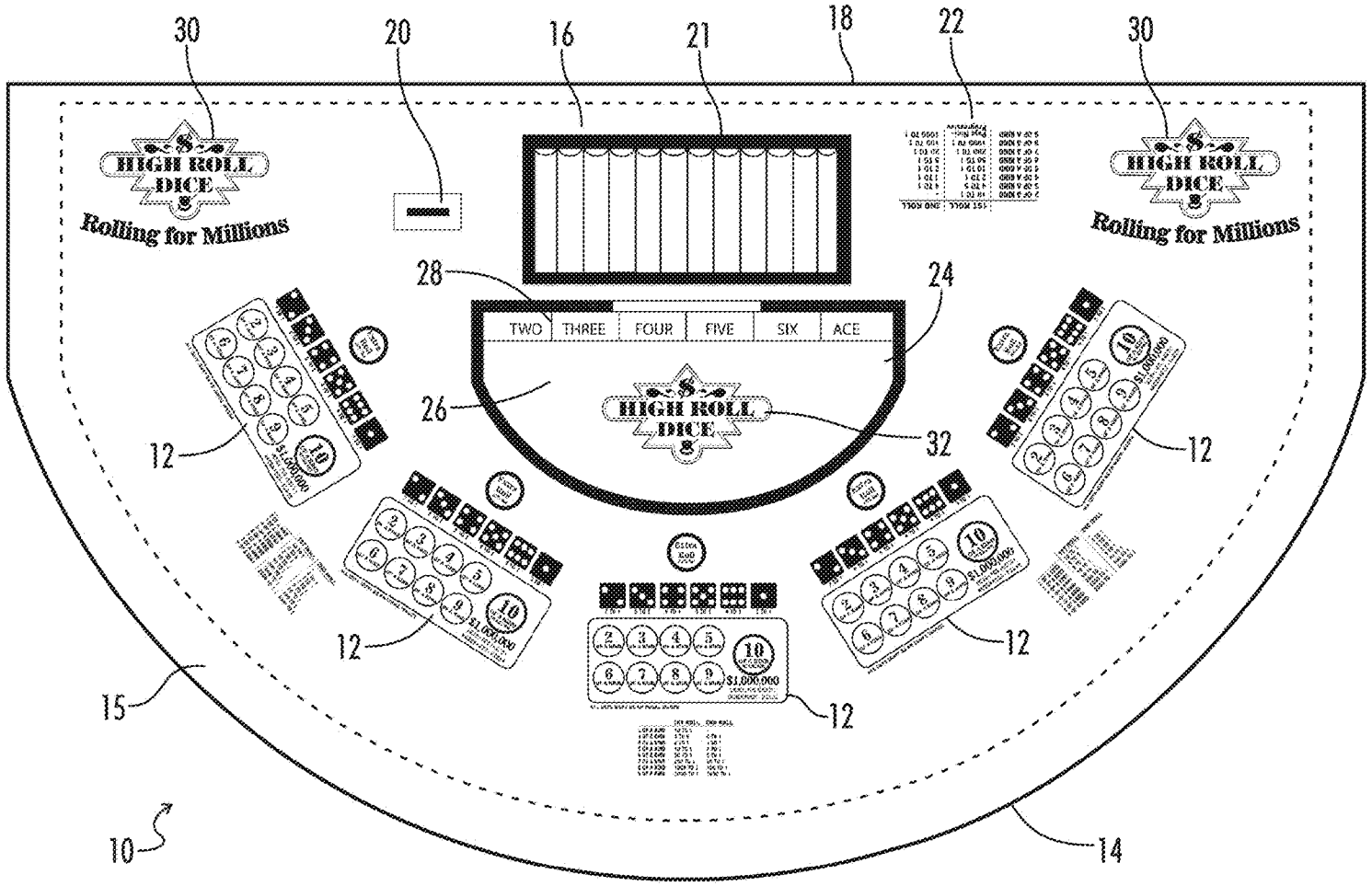
FIG. 1 is a plan view of an embodiment of the casino dice table game of the present invention.

FIG. 1 depicts a preferred game table layout or area 10 for use in practicing and implementation of the casino table game and method of play of the present invention. The game table 10 has a covering thereon made of felt or other suitable material, having a plurality of player stations 12 imprinted thereon, which player stations 12 are spaced apart around the front side 14 of the game table, spaced from rail 15. As illustrated, there are five player stations 12. However, a greater or lesser number of player stations 12 may be provided depending upon the size of the playing area. The dealer's area, generally indicated by reference number 16, is situated along the rear side 18 of the game table, and includes a money slot 20 in which cash given to the dealer as payment for game chips or tokens is placed in a manner well known to those skilled in the art. In addition, a chip or token rack 21 in which house game chips or tokens for use during play of the present game are arranged in columns and stored, and a payout schedule 22 which the dealer can refer to as needed, are also shown.

Located in the center area of game table 10 is a dice throw box 24. Throw box 24 is preferably recessed into the playing surface of table 10, and as described below the dice utilized during play of the game are rolled in the throw box. As shown in greater detail in FIG. 3, in one embodiment dice throw box 24 includes a high roll dice area 26 in which the dice are thrown or rolled, and a dice sorting area 28. Additional indicia 30 provided on game play area 10 may include logos or other decorative indicia that identifies the game of the present invention, such as the name "High Roll Dice". An exemplary logo 32 is also shown in dice throw area 26 of throw box 24.

Figure 2:
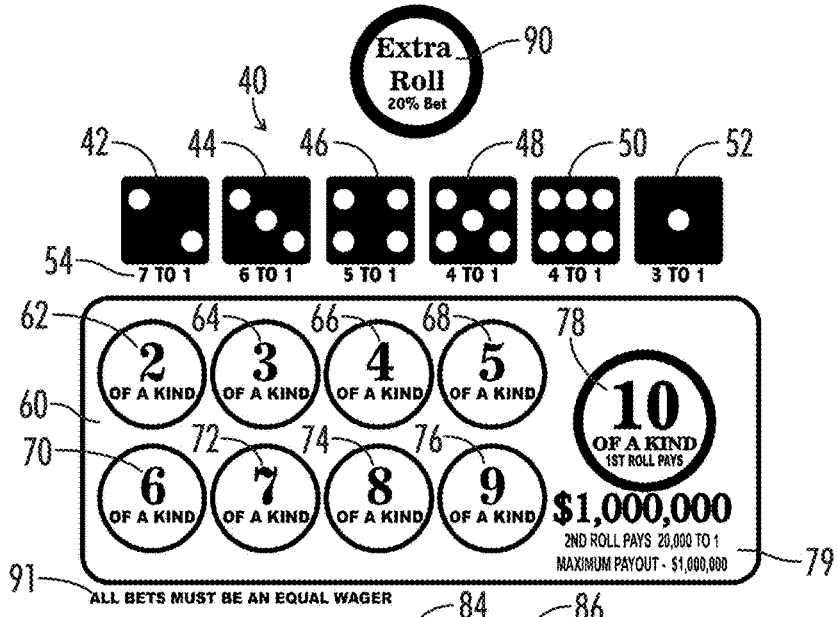
FIG. 2 is a close-up view of one of the player stations shown in FIG. 1 on the game table of the present invention.

FIG. 2 is a close-up view of one of the player stations 12 on the game table 10 shown in FIG. 1. Each player station 12 has a layout that is identical to all other player positions, and in the present embodiment may be described as including three wagering zones, although as will be described the third wagering zone is utilized primarily to purchase or pay the ante for wagers or bets made in the second wagering zone. Wagering Zone One is indicated generally by reference number 40, and is comprised of "dice wager roll" wagering spots 42, 44, 46, 48, 50, and 52. Each wagering spot 42-52 depicts a different one of the die faces of a conventional six-sided die in the shape of a cube, represented by having a different number of dice pips ranging from one to six (each die has six sides with indicia representing the numbers one through six). It will be understood that in other embodiments different indicia such as numbers, symbols, lettering, or other indicia or combinations of indicia may be used to depict a die face, and in still other embodiments additional nonconventional dice having more or less than six sides and different shapes may be utilized in accordance with the present game, in which case the indicia imprinted on the die may be different. Printed beneath each wagering spot 42-52 is a payout scale 54, which indicates the particular payout for a wager placed on each of wagering spots 42-52.

Wagering Zone Two is indicated generally by reference number 60, and in the presently described embodiment is comprised of "like king" wagering spots 62, 64, 66, 68, 70, 72, 74, 76, and 78. Each of wagering spots 62-78 in Zone Two 60 is shown as a circle, although the wagering spots may be represented using different shapes or markings. Wagering spots 62-76 are logically arranged in two aligned rows, and have indicia such as "2 Of A Kind", "3 Of A Kind", etc. up to "9 Of A Kind" imprinted thereon. Wagering spot 78 in Zone Two 60 is situated to the right of the two rows of wagering spots 62-76, and is formed of a larger circle with the wording "Ten Of A Kind" imprinted in the circle. Also imprinted in the "Ten Of A Kind" wagering spot 78 are the words "1st Roll Pays", while directly underneath wagering spot 78 in larger print is "$1,000,000", and in smaller print "2$^{nd}$ Roll Pays 20,000 to 1", comprising the payouts for wagering spot 78 on first and second rolls during game play. In addition a "Maximum Payout" 79 is listed for wagering spot 78, which in the exemplary embodiment is "$1,000,000". A payout table 80 for wagering spots 62-76 Wagering Zone Two 60 is provided underneath Wagering Zone Two 60, which table has a first column 82 listing each wagering spot 62-76, a second column 84 listing the payout for wagering spots 62-76 on the first roll, and a third column 86 listing the payouts for wagering spots 62-76 on the second roll. A preferred method of play regarding the outcomes of the first and second roll is described below.

Wagering Zone Three in the presently described embodiment is comprised of wagering spot 90, which is positioned centered directly above Wagering Zone One 40. Wagering spot 90 is shown as a circle with the wording "Extra Roll 20% Bet" imprinted in spot 90. Finally, the wording "All Bets Must Be An Equal Wager" 91 is provided underneath Wagering Zone Two 60, which, as explained below means that the value of any bet placed on any of the wagering spots 44-52 in Zone One 40, or any of the wagering spots 62-78 in Zone Two 60, must have an equal value. "Extra Roll" wagering spot 90 is used to purchase a wager or bet on the second roll during game play, and the wording "20% bet" on Zone Three wagering spot 90 indicates that the value of the wager or bet that must be placed on spot 90 is 20% of the value of the bets placed on any of the wagering spots in Zone One 40 or Zone Two 60. It will be understood that in other embodiments this value can be set at other figures by a casino establishment or regulatory authority.

Figure 3:
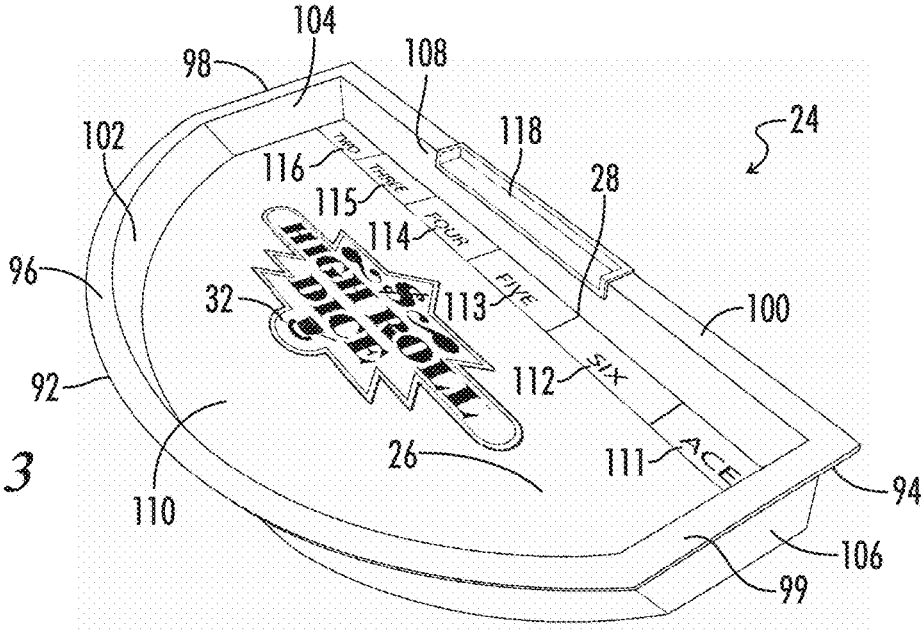
FIG. 3 illustrates a dice throw box in accordance with the game table of the present invention.

As indicated above, FIG. 3 is a close-up perspective view of a dice throw-box 24 in accordance with the invention, which as indicated previously is preferably recessed into the surface of table 10. Throw-box 24 includes a peripheral rim 92 which when the throw-box is mounted on the game table is approximately level with the surface of the table. In a preferred arrangement, the underside 94 of rim 92 abuts against the surface of table 10, supporting the throw box 24 in an aperture in the table. Rim 92 has a curved forward facing section 96, short side sections 98 and 99, and a rear section 100. Extending downwardly from rim sections 96, 98, 99, and 100 are sidewall sections 102, 104, 106, and 108, respectively, which meet throw-box floor 110 at their lower ends. Sidewall section 102 preferably slants inwardly with respect to floor 110 at an angle of approximately ten degrees, which during play of the table game aids in keeping the rolled dice from bouncing out of throw-box 24.

Floor section 110 includes a dice throw area 26, which generally comprises the forward area of floor 110 situated between side wall sections 102, 104, and 106, and a dice sorting area 28 adjacent rear sidewall 108. In the present embodiment, sorting area 28 is further divided into six equal-sized sorting areas 111, 112, 113, 114, 115, and 116, each labeled with indicia indicative of one of the six possible results of a roll of a conventional six-sided die. Logo or watermark 32 is centered on floor 110 of dice throw area 26. In addition, a recessed display area 118 is provided on rear section 100 of rim 92 and sidewall 108, in which the dice used during play of table game 10 may be stored when not in use, and more importantly where the "High Roll" dice are placed and displayed after each initial roll during game play game. Display area 118 allows the "High Roll" dice to be physically separated from the other dice, and area 118 is situated so that these dice are easily visible not only to each of the players, but also to securing cameras in a casino gambling floor area.

FIG. 4 illustrates several accessories utilized during play of the table game 10 of the present invention, namely set of dice 120, shaker 122, and a plurality of play tokens or casino-style chips 124. Dice 120 are inserted in shaker 122 to roll or throw the dice 120 during game play such that the die are ejected out of shaker 122 and tumble in the air as well as on the throw box surface, and when the set of dice come to rest the upwardly exposed or directed face provides a random indication to be used in the play of table game 10. A supply of chips or tokens 124 is kept by the dealer in chip rack 21 in game play area 10 as shown in FIG. 1, and of course in addition each of the players also will have their own supply of purchased game tokens or chips 124 for use during game play. Dice 120 and dice shaker 122 will also be kept in or at least in close proximity to the dealer's area 16.

A preferred method or methods of play of game 10 will now be described with reference to the exemplary embodiment described above. The present game can be played by between one and five players, although this can vary based on the size of the playing table and number of player stations 12 available. The dealer, who will normally be positioned along the rear side 18 of the table, will initiate play, and offers each player the opportunity to place at least one bet or wager on such player's player station 12 in Wagering Zone One 40, and also one or more additional bets or wagers in Wagering Zone Two 60 or Wagering Zone Three 90. In the presently described method of play, all wagers made in any of the Wagering Zones 40, 60 or 90 may only be made at the start of a new game, although in other embodiments it may be possible to make one or more additional side bets or wagers either before or after the first roll. Bets or wagers are made by placing one or more tokens or game chips 124 on one or more of the wagering spots 42-52 in Zone One 40. In addition, the players will optionally place one or more different tokens or game chips 124 on one or more of wagering spots 62-78 in Zone Two 60, and optionally purchase an "extra roll" by placing another token or game chip 124 on Zone Three wagering spot 90. In the presently described embodiment, all players must make at least one wager in Zone One 40, although in another embodiment described below with particular reference being made to FIG. 8, placing a wager in Zone One 40 is not mandatory. Wagers placed in Zone One 40 or Zone Two 60 must be equal to or greater than the house wager minimum for the particular table, which may be set at, for example $1, $5, $10, $25, $50 etc. in a conventional manner. In addition, in one embodiment all bets placed on any of the wagering spots in Zone One 40 and Zone Two 60 must be of an equal value or denomination, as indicated at 91 in FIG. 1. Thus, for example, if a $10 wager is made by placing chips 124 having a total value equal to $10 on any of wagering spots 44-52 in Zone One 40, the value or denomination of any other wagers made on other wagering spots 44-52 in Zone One 40, or any of wagering spots 62-78 in Zone Two 60, must have the same $10 value.

Once all of the players have been given an opportunity by the dealer to place their wagers or bets, the dealer will indicate that no more wagering is allowed for that game, such as by making a "no more wagering motion" by moving his or her arm in a sweeping motion over the top of the table from one end to the other. The dealer will then pick up the plurality of dice 120 and place them in dice shaker box 122, shake the dice in shaker box 122, and then roll or throw all of the dice 120 into throw area 26 of dice throw box 24. In the illustrated embodiment, a total of ten dice are used. For security purposes, it is preferred that only the dealer be allowed to touch or roll the dice during game play, although other rules may allow one of the players to roll the dice. To be an "Official Roll", all ten dice must land in throw box 24, and in addition must lie flat upon the bottom surface 110 of the throw box. If any dice 120 bounce out of or leave the throw box 24, or sit stacked or tilted in the throw box, this is considered a "break" and all ten dice 120 must be rolled again.

After the first or initial roll of dice 120 to begin the game has been made, the dealer will determine the results of the first roll by moving the dice into dice sorting area or grid 28 in throw box 24. In other words, the dealer will slide or move each of dice 120 into one of designated sections 111-116 of the sorting area 28 according to the outcome of the roll, and according to the dice indicia facing upwardly in throw box 24. Preferably, the dice 120 are moved to designated sections 111-116 from the dealer's left to right, which as illustrated is in order of ranking or priority Aces/Ones (ranking the highest) 111, Sixes 112, Fives 113, Fours 114, Threes 115, and Twos (ranking the lowest) 116, by "like kind". Once the dice have been sorted, the dealer will preferably "clear" his or her hands to security by holding then up so they are within clear view of the casino security camera system. Then, the dealer will determine which group of dice comprises the "High Roll" dice, or the highest ranking and highest number like kind indicia dice, and such "High Roll" dice are then moved from the sorting area to the elevated "High Roll" dice display area 118, which as indicated above is situated on the rim section 100 of the throw box 22.

The group of "High Roll" dice resulting from an initial roll of ten dice 120 is determined as follows. First, the dealer determines which group of dice from the initial roll of set of dice 120 contains the greatest number of "like kind" dice, or identical dice indicia, having landed facing upwardly. Second, where there are two or more groups containing the same highest number of "like kind" dice, the set having the highest ranking pip or indicia value becomes the group of "High Roll" dice. The present inventors have unexpectedly discovered during design of the present table game that by allowing separate wagers or bets to be placed on possible outcomes and combinations of possible outcomes of such dice roll, a very challenging and yet easily understood and entertaining table game results. In the presently described embodiment, in Zone One 40, players place wagers on which dice indicia they believe will comprise the group of "High Roll" dice upon an initial roll. In Zone Two 60, players can optionally place wagers on the actual number of dice that will be included in the initial group of "High Roll" dice.

Thus, after determining which dice from the initial roll make up the group of "High Roll" dice, the dealer will then examine the individual player stations 12 to identify which if any players placed wagers that correctly predicted the makeup of such group of "High Roll" dice. In Zone One 40, the dealer will check to see if any players placed wagers on the dice wagering spot which matches the highest ranked "like kind" dice or dice indicia resulting in the initial roll, which is payable individually as per payout schedule 54. As indicated previously, the payouts listed in the application are merely exemplary, and other payout arrangements or schedules may be substituted according to the preference of the casino or gambling establishment.

Wagers made in Zone One 40 are based solely on a player's prediction of the results of the outcome of the initial roll of set of dice 120. According to the rules of the game in the presently described embodiment, at least one wager must be made on one of wagering spots 42-52 in Zone One 40. The at least wager in Zone One 40 will include the wagering spot the player predicts will equal the highest ranking "like kind" dice or dice indicia resulting from the initial dice roll in a game, which as indicated above will consist of the group of dice 120 with the greatest number of occurrences of a numerical indicia or pip value facing upwardly, or where there is a tie, the player must have bet on the "like kind" die with the highest numerical pip value or indicia ranking. For example, if upon an initial roll of the ten dice 120 a player predicts the number "two" will land face up the greatest number of times, such player will then place a wager having a value equal to or greater than the minimum wagering bet for the table on wagering spot 42. Players can place wagers on more than a single wagering spot 44-52 in Zone One 40 during the same game, or even on all of wagering spots 42-52 as desired.

Continuing with the above example, if the result of the initial roll of ten dice 120 is that the number "two" lands face up four times, the number "three" lands face up three times, the number "six" lands face up two times, and the number "five" lands face up one time, the player who placed a wager on wagering spot 42 in Zone One 40 is a winner and is awarded the indicated payout 54. However, if the result of the initial roll of ten dice 120 is that the number "two" lands face up four times, the number "three" lands face up three times, and the number "one" or "ace" also lands face up four times, the player is a loser, unless he or she also placed a bet on wagering spot 52, in which case the player is also a winner. In the exemplary embodiment, an "ace" is considered the highest value roll, followed by sixes (6's), fives (5's), fours (4's), threes (3's) and twos or deuces "2's. However, the pip values could be ranked differently, or different symbols or ranking hierarchy could be utilized while still falling within the intended scope of the invention.

In addition to clearing and paying out all of the wagering results in Zone One 40, the dealer must also examine any wagers placed on wagering spots 62-78 in Zone Two 60 for each player, where bets on the actual number of dice that make up the group of "High Roll" dice are placed. Thus, while in Zone One 40 players place wagers or bets on which dice indicia upon rolling ten dice 120 will have the highest number of occurrences landing face up, and in the case of a tie also having the highest ranking pip value, in Zone Two 60 players are betting or wagering based on their prediction or guess as to what the highest number of occurrences of a dice indicia that will actually result from such first or initial roll will be. For example, if a player predicts that six dice will land face up with the pip value or number indicia four, such player can place a wager on the pip value or number four in Zone One 40 by placing a game token or chips on wagering spot 46, and in addition the player can place a separate wager or bet of the same amount that six "fours" will occur or land face up by placing a game token or chips on wagering spot 70 in Zone Two 60. Since the Zone Two 60 occurrence of "Six of a Kind" on a first or initial roll is fairly rare, the payout for such first roll 70 is fairly high, as indicated in the present example in table 80, 1$^{st}$ Roll Column 82, at fifty to one. At the same time, one or more other wagers or bets may be placed on additional wagering spots in Zone One 40 or in Zone Two 60 by placing token or game chips on such other wagering spots.

Yet another feature of game 10 is that if a wager or wagers are made in Zone Two 60, the player has the option of making an "extra roll wager" in Zone Three 90. Any wager in Zone Three 90 must also be made at the start of the game.

An "extra roll wager" affords each player the opportunity to win "like kind roll" wagers made in Zone Two 60 on an additional or second roll of the remaining dice in play after the initial roll, or in other words, a roll of those dice that were not part of the group of "High Roll" dice previously removed from play after the first roll and placed in display area 118. In effect, by placing a wager in Zone Three 90, the player is purchasing an extra roll with respect to the bets or wagers made in Zone Two 60. To qualify for the opportunity to win on the results of a second roll, before the first roll the player must have placed at least one "like kind roll" wager in Zone Two 60 that turns out to be greater than the "like kind roll" wager resulting from the initial roll. In addition, such player must have made an "extra roll wager" at the start of the game by placing a token or game chip on the Zone Three wagering spot 90. If no "extra roll wager" was placed at the start of the game, then any "like kind wagers" are eligible for payout based on the results of the first or initial roll only. In a preferred embodiment, the amount of the wager made on an "extra roll wager" in Zone Three 90 does not have to be equal to the amounts of the player's wagers or bets made in Zone One 40 or Zone Two 60. In one embodiment, the amount of an "extra roll wager" in Zone Three 90 will be equal to one-fifth (20%) of the minimum table wager, although such wager could also be calculated in other ways, such as being equal to the minimum table wager, or twenty percent of the wagers made in Zone One 40 and Zone Two 60. Players cannot place a wager in Zone Three 90 alone, and a Zone Three 90 wager must be played in conjunction with a "like kind wager" made in Zone Two 60.

When analyzing the bets made by each player, the dealer therefore must also determine whether a player "purchased" an "extra roll wager" by making any bets or wagers in Zone Three 90. For players who did not make an "extra roll wager" in Zone Three 90, the dealer then pays out any winning wagers in Zones One and Two, and collects all of the losing wagers, clearing the player board of wagers for these players, for who game play in the current round or game is ended.

For players who did make an "extra roll wager" in Zone Three 90, the dealer pays out any winning wagers and collects any losing wagers made in Zone One 40, clearing Zone One. In addition, the dealer pays out any winning wagers in Zone Two, and prepares the table for the "extra roll wager" eligible players. For "extra roll wager" eligible players, all "like kind" wagers in Zone Two that are less than the results of the first or initial roll are considered losing wagers and are claimed by the house and are collected by the dealer. If an "extra roll wager" eligible player has a "like kind" wager that is higher than the first or initial roll payable "like kind" payout, these wagers or chips are left on the wagering spots in Zone Two. In addition, since the "extra roll" wager is not a separate payout zone, the dealer collects all chips or wagers placed on the Zone Three wagering spot 90. As discussed below, in another embodiment, a means for indicating which players have made an extra roll bet such as by providing an illumination means or otherwise marking each wagering spot 90 is provided.

After the dealer has completed play of game 10 with respect to the initial roll, the dealer will make the "Extra Roll". As indicated above, the "Extra Roll" is a second roll of the remaining dice that were not part of the group of "High Roll" dice in the first roll, which were taken out of play after the initial roll. Similar to the initial roll, in the "Extra Roll" the dealer places the remaining dice in play from the original set of dice 120 in throw cup 124, shakes the cup, and then the remaining dice are rolled or thrown into throw box 26 in one motion. Similar to the first or initial throw, all remaining dice 120 must make land in the throw box and lie flat upon the bottom surface 110 of the throw box 120 for the roll to be considered an "Official Roll". If any dice leave the throw box, or are sitting stacked or tilted in the throw box, this is considered a "Break" and the dice must be rolled again.

Upon completion of the "extra roll wager" throw, the dealer will sort the remaining dice, and add those dice whose upwardly facing numerical value or indicia is the same as the dice previously placed in the "High Roll" area 118, which are the original set of "like kind" dice, to such "High Roll" area 118. Then, the dealer will establish the payout for the second roll or "Extra Roll" for those players who having eligible "like kind" wagers on positions higher than the initial or original payout from the first or initial dice roll of the game.

As a further example, assume a player places a "dice wager" on 5's (wagering spot 48) in Zone One, "5 Of A Kind" (wagering spot 68) in Zone Two, and also purchases a second roll by placing an "extra roll wager" (wagering spot 90) in Zone Three. If the result of the first or initial roll of the set of dice 120 is that the dice number with the highest number of occurrences is "Three", or wagering spot 44 in Zone One 40, and this occurs three times, or wagering spot 64 "3 Of A Kind" in Zone Two 60, the player loses the Zone One 40 bet or wager. In addition, the player did not win the Zone Two 60 bet on the first roll, since the player bet on "5 Of A Kind" (wagering spot 68). However, since an "extra roll wager" was also made in Zone Three (wagering spot 90), and in addition since the wager made in Zone Two 60 on wagering spot 68 is greater than the actual first roll outcome, such player is now eligible to win on the second roll of the remaining dice. Thus, if on the second roll two more "Three's" (3's) are rolled, raising the total number of three's rolled in the game from three to five, such player is a "winner" on the second roll, and will receive the second roll payout 86 for wagering spot 68, which is indicated on table 80 as being "2 to 1". At this point, game play in such round of play is ended for the player, unless the game is also provided with one or more possible side bet areas, which, for example might afford a player an opportunity to double their winning on a Zone One 40 bet, a Zone Two 60 bet, or the like. In another embodiment, a side or bonus wager or bet may be available only on the first roll, doubling or otherwise increasing the roll odds.

The present game can also be utilized in other embodiments, including a cumulative or progressive jackpot feature. FIG. 5 illustrates an exemplary player station layout 212 which has been modified to include such a progressive jackpot feature. Layout 212 is similar to the layout of player station 12 illustrated in FIG. 2. However, in the FIG. 2 layout, if a player places a bet or wager on wagering spot 78 in Zone Two 60, and if the initial dice roll of ten dice 120 results in "10 Of A Kind", or in other words all ten dice 120 land with the same pip value or other indicia facing upwardly, as indicated directly underneath wagering spot 78, the player wins one million dollars. In addition, if "10 Of A Kind" is achieved on the second or "Extra Roll" in game station 12, the player is awarded a payout of "20,000 to 1". In contrast, in the embodiment of game layout 212 shown in FIG. 5, which includes a "progressive jackpot" feature, if a player places a bet or wager on wagering spot 78 in Zone Two 60, and if the initial dice roll of ten dice 120 results in "10 Of A Kind", or in other words all ten dice 120 land with the same pip value or other indicia facing upwardly, as indicated by reference numeral 152 directly underneath wagering spot 78, the player wins the "Progressive Jackpot", while if "10 Of A Kind" is achieved on the second or "Extra Roll" the player is awarded a "Minor Progressive".

In a progressive jackpot version of the game, in one embodiment the "Progressive Jackpot" accumulates incrementally, in one embodiment based on the number of "Extra Roll" wagers or those wagers placed on Zone Three wagering spot 90 to "purchase" a wager or bet on the second roll in each game. Each time a player plays an "Extra Roll" wager, such wager or a portion of such wager is added to the progressive jackpot. In another embodiment, a plurality of table games 10 either in the same location or at different locations or both are linked together electronically so that in regular play on the game, players may compete for a common award or progressive jackpot or minor progressive jackpot. This allows the jackpot build-up to be larger and accumulate more quickly, as it is an accumulation of wagers or bets made at more than one table in a casino, or in the event of electronic links or networks of multiple tables and from multiple casinos situated at locations distant from each other, the number of participating players and the size of the jackpot can be even further and more quickly increased.

In one embodiment, a counter means for automatically adding a sum to the progressive jackpot each time a chip or wager is placed on a Zone Three wagering spot 90 is provided. This could be implemented in different ways. In one possible arrangement, the dealer would manually place all of the "Extra Roll" wagers in a separate box or containment area having a counting device connected to the money slot such that each time a game token or chip is inserted in the slot, it is counted by activating the counter means and a sum is added to the progressive jackpot. In another possible arrangement, when clearing the table of "Extra Roll" chips, the dealer may record each token chip played on the "Extra Roll" wagering spots by manually inputting the number into a computer or counter device, which device is connected to a computer network and transmits the data to a main computer for processing. A counter system could also be incorporated directly into Zone Three wagering spot 90, wherein, for example, a means such as a camera embedded in the game table underneath wagering spot 90 for detecting when a token or chip is placed on wagering spot 90 may be provided. Such counter means would also be connected to a computer system network so that a sum could be automatically added to the progressive jackpot whenever a token or chip was detected on wagering spot 90, or perhaps when the token or chip was cleared and readied for the next game. The recorded sum could also be automatically split into different amounts and redirected to a progressive jackpot, or other different accounts according to the particular arrangement of the casino establishment.

Figure 6:
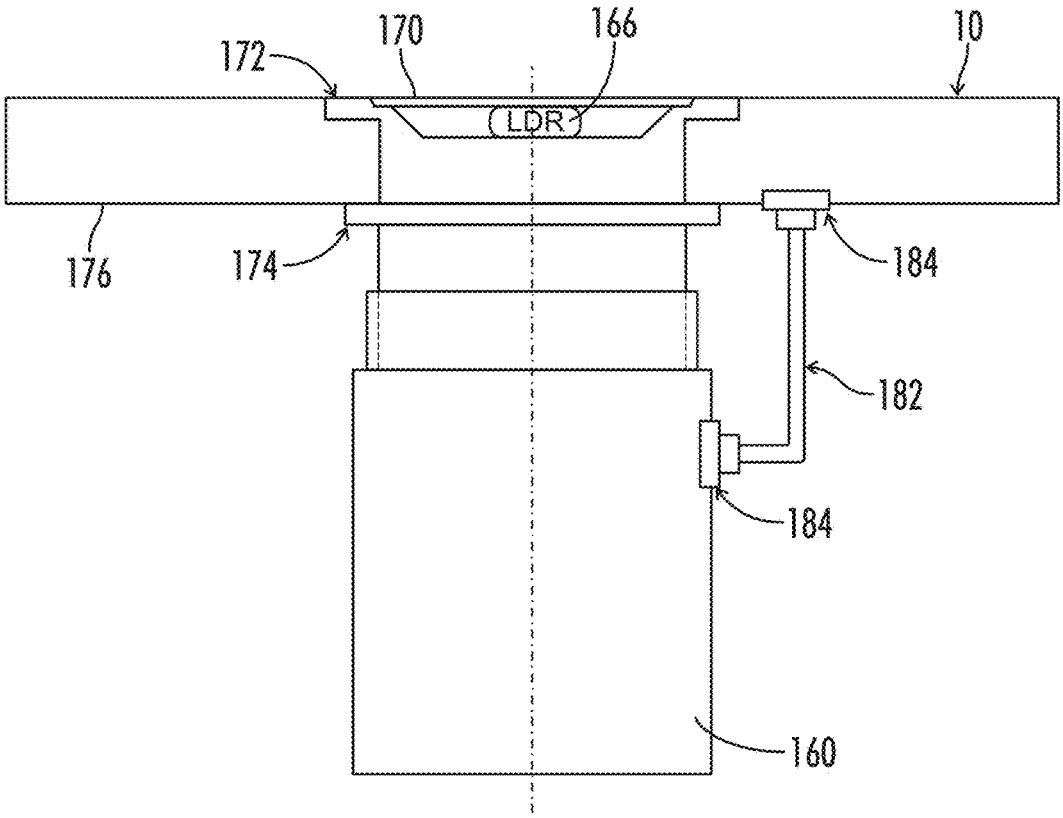
FIG. 6 illustrates an embodiment of the "extra roll" wagering spot sensor holder of the present invention.
Figure 7:
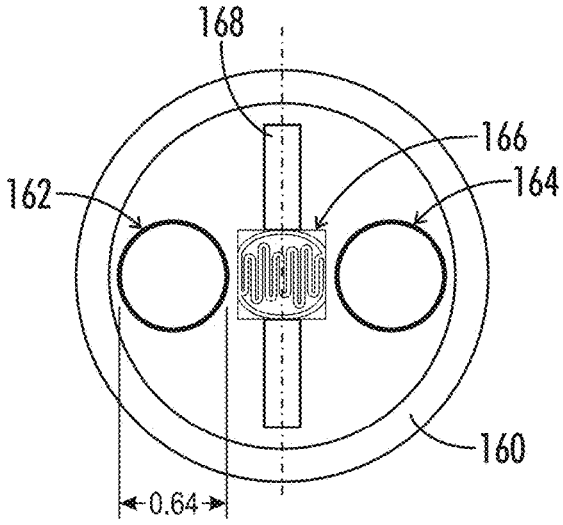
FIG. 7 is a top view of the sensor holder shown in FIG. 6.

In another embodiment, wagering spot 90 is adapted to automatically illuminate upon a token or chip being placed on such spot, indicating visually that an "Extra Roll" bet has been made. In addition, preferably wagering spot 90 upon being illuminated will remain in this state after the dealer removes the wagered amount (chip) from wagering spot 90 at the end of the first roll. The illuminated spot will continue to visually evidence to both the dealer and to the players which player or players "purchased" or paid the ante for the second roll in the particular game and therefore are eligible for the second roll. A preferred arrangement for illuminating wagering spot 90 is through provision of a light sensing circuit which is used to switch an LED light on and off according to certain conditions. FIGS. 6-7 illustrates a possible arrangement for accomplishing this, whereby wagering spot 90 is provided with a sensor housing 160 in which two light emitting diodes (LED) 162 and 164 are contained. In addition, a photoresistor or light dependent resistor (LDR) 166 is mounted in cylinder or housing 160, and both LED's 162-164 and LDR 166 are connected to a control system including circuit board 168. Also provided over the upper end of cylindrical housing 160 is a transparent or translucent sensor cover top or lens 170. In an initial state, LED's 162-164 are turned off, and since the lens 170 is transparent or translucent, LDR 166 is exposed to room light, which keeps the resistance of LDR 166 low. However, when a wager is bet is made on the "Extra Roll" wagering button 90 in Zone Three, a token or game chip 124 is placed on lens 170, which blocks the room light from passing through lens 170 reducing the intensity of the room light 170 reaching LDR 166, thereby also increasing its resistance. When the amount of current passing through LDR 166 is reduced, the control system causes LED's 162-164 to turn on. Later, when the token or game chip 124 is removed from lens 170 by the dealer, the intensity of the room light reaching LDR 166 increases, causing the resistance of LDR 166 to decrease again. However, the control system is programmed to keep LED's 162-164 on until the system is manually reset, which the dealer can perform by pressing a manual switch or the like after the end of each game. Preferably, the dealer can also reset individual player LED lights, so that if a player attempted to play an "Extra Roll" but does not have any remaining eligible wagers in Zone Two 60, the dealer can turn their LED lights 162-164 off also to prevent any possible confusion.

Cylindrical holder 160 may have a reflective inner wall, which is lined with a reflective material such as alumina foil. Holder 160 also has a flange 172 on its upper end which is used to support the cylindrical holder 160 to table surface 10, with the holder 160 extending downwardly through an aperture in the table surface. A lock nut 174 is threadably secured to the outer surface of holder 160 near its upper end, and is turned on the threads so as to be tightened against the underside 176 of the game table 10, securing the cylinder and its components in place. A master control box is also preferably provided, which is mounted to the game table in a convenient location and may be used by the dealer to control the "Extra Roll" light circuit. The master control box is connected to the circuit board 168 by a ribbon cable 182, shown in FIG. 6, having wire plugs 184 such that either the control box or holder 160 can be more easily removed and replaced if defective by unclipping the component from the wire plug 184. The master control box preferably includes at least main power switch, and reset switch for resetting the entire system after each game is completed. A dimmer switch is also preferably provided so that the intensity or brightness of the LED's may be adjusted depending upon whether or not the game table is in a bright or darker room environment. In addition, the control box also may include several lights, one for each player station and "Extra Roll" wagering tab 90, which aid the dealer in quickly determining which players are eligible for the second roll wager during play of the table game.

Figure 8:
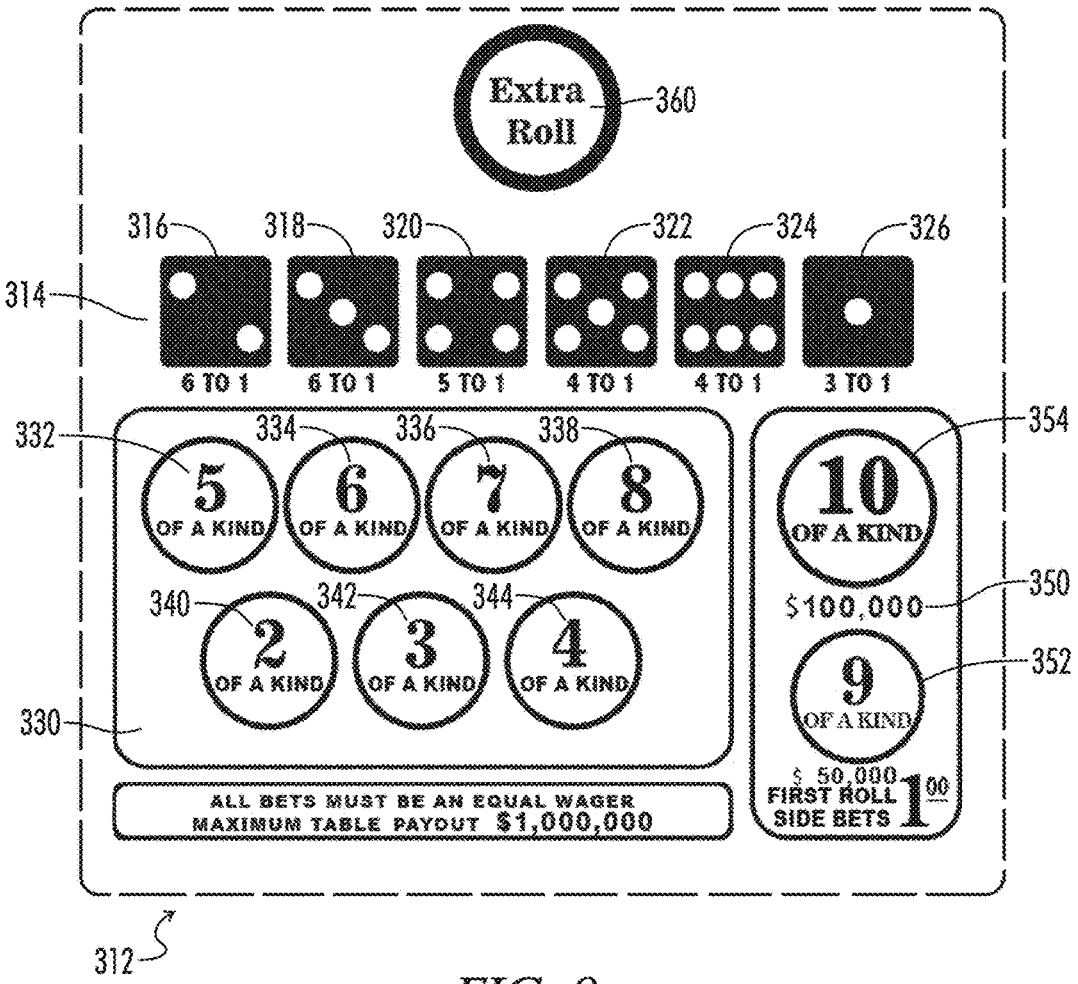
FIG. 8 is a view of another alternative player station layout.

FIG. 8 is a close-up view of another exemplary embodiment of one of the player stations to be used in accordance with the present invention. Similar to player station 12 shown in FIG. 2, player station 312 in FIG. 8 also includes a "dice wager roll" wagering zone or area 314, having a plurality of individual wagering spots 316, 318, 320, 322, 324, and 326 each depicting one of the die faces of a conventional six-sided die to be used during game play. It will be understood that different or unique indicia such as numbers, symbols, lettering, or other indicia or combinations of indicia may be used to depict a die face, and in additional nonconventional dice may be utilized in accordance with the present game. In one embodiment, at least one wagering spot in wagering zone 314 should include or depict each of the different or unique indicia on the dice. In another embodiment of the invention, the number of wagering spots in zone 314 should equal the number of different indicia on each of the dice, while in another embodiment the number of wagering spots in zone 314 should equal the number of sides on the plurality of dice. Payout scale 328 which indicates the particular payout for a wager placed on each of wagering spots 316-326 is also similarly provided underneath the wagering spots in zone 314. Bets made in wagering zone 314 in the "High Roll Dice" game are sometimes fancifully referred to as "pip street" bets.

A second wagering zone or area 330 includes a plurality of "like kind" wagering spots 332, 334, 336, 338, 340, 342, and 344. Each of the wagering spots 332-344 in wagering zone 330 includes an indicia such as "2 Of A Kind", "3 Of A Kind", etc. up to "8 Of A Kind" imprinted thereon, and a payout table, not shown for wagering zone 330, would be situated in close proximity to each player station 312. Bets made wagering zone 330 in the "High Roll Dice" game are sometimes fancifully referred to as "like kind boulevard" bets. In the exemplary embodiment, therefore, there are seven separate wagering spots in wagering zone 330, each representing a different possible outcome of the number of highest ranking dice indicia that will land facing upwardly upon a dice roll. In one embodiment, the number of different wagering spots in second wagering zone 330 is between five and nine, while in another embodiment the number of different wagering spots in the second wagering zone 330 is seven or eight.

In addition, a third wagering zone or area 350 is provided, which includes wagering spots 352 and 354. In the embodiment shown in FIG. 8 where there are ten conventional dice being utilized, the "Nine Of A Kind" wagering spot 352 and "Ten Of A Kind" wagering spot 354 are categorized as a separate wagering zone as compared to the embodiment of player station 12 shown in FIG. 2. Third wagering zone 350 is generally reserved for larger payoffs than wagering zones 314 and 330. In the presently described embodiment, the indicated prize for wagering spot 352 is $50,000, and the indicated prize for wagering spot 354 is $1,000,000. Bets made wagering zone 350 are sometimes fancifully referred to as "millionaire row" bets. In the embodiment illustrated, the two wagering spots in wagering zone 350 each represent a different possible outcome of the number of highest ranking indicia that will land facing upwardly upon a dice roll. In one embodiment, the number of different wagering spots in third wagering zone 350 is between one and four, while in another embodiment the number of different wagering spots in the third wagering zone 350 is one or two. In addition, third wagering zone 350 will include one wagering spot which represents a possible outcome of a first dice roll in which all of the dice land with the same unique indicia facing upwardly. Each of the wagering spots in wagering zone 350 also is associated with dice roll outcomes where a greater number of the dice land with the same unique indicia facing upwardly than the wagering spots in wagering zone 330. In another embodiment, additional side bets will be made available in wagering zone 350 or in a separate wagering zone.

In addition, positioned under wagering spot 352 is indicia which reads "First Roll Side Bets $1.00." It will be understood that the value of placing a side bet wager in wagering zone 350 could be higher or lower than $1.00 depending upon the casino preferences. In addition, similar to the previous embodiments, an "extra roll" wagering spot 360 is provided whereby the player can elect to be eligible for outcome of the second roll in accordance with the method of play of the table game. The wording "All Bets Must Be An Equal Wager" 366 is provided underneath wagering zone 330, which, as explained means that the value of any bet placed on any of the wagering spots in wagering zone 314 and wagering zone 330 must be equal, while the amount placed on extra roll wagering spot 360 is a designated percentage of the bet placed in wagering zones 314 or 330. In the presently described embodiment, bets made in wagering zone 350 are considered side bets because the wagers placed in wagering zone 350 do not have to be the same amount or an equal wager with wagers made in the other wagering zones. The maximum table payout will also be listed, which it will also be understood may be adjusted by the casino or gambling establishment.

In a preferred method of play using player station 312, a first difference as compared to the method described above with respect to player station 12 is that in player station 312 players are not required to place a wager or bet in wagering zone 314. The players can now place one or more wagers in "pip street" wagering zone 314, or in "like kind boulevard" wagering zone 330, or in both wagering zones 314 and 330. If a wager is placed in one of the wagering spots 332-344 in "like kind boulevard" wagering zone 330, the player can also wager on the "extra roll" or second roll of the dice as described above by placing an ante in wagering zone 360. In addition, the players can also place a side bet in "millionaire row" wagering zone 350 on either or both of wagering spots 352 and 354 for a set cost or fee, which cost or fee in the illustrated embodiment is $1.00. It will be understood that the side bets in wagering zone 350 are only with respect to the outcome of the first roll, and that any bets placed in zone 350 are collected by the dealer after the first roll if the player is not a winner in the side bet.

By not requiring the players to place a bet in wagering zone 314 on the dice roll outcome with the most matches of highest ranking or priority on the first roll, and making the wagers on the nine and ten-of-a-kind outcome in wagering zone 350 a side bet, casino or gambling establishments are offered additional flexibility in customizing the game, as well as adjusting the odds of winning in the various wagering zones, to meet local guidelines as well as to adjust the overall profitability of the game for the casino without reducing its attractiveness to customers.

It should be evident that the table game of the present invention described herein provides a method of game play that is at least as exciting and entertaining as existing dice games, and in addition is completely innovative in that each roll affords the players the opportunity to win a large payout equal to the size of many instant lottery jackpots. The several modes of play of the present game in combination with the opportunity to achieve a large payout, as well as provision of a game in which ten dice are thrown simultaneously on the first roll makes such game unique while still being easy to learn and understand, unlike most other casino table games known in the prior art.

Other embodiments of the game in addition to those specifically described may fall within the intended scope of the present invention. While the present game is described using ten dice, in another embodiment a greater or lesser number of dice could be utilized, namely between eight or twelve dice, although it has been found that utilization of ten dice is most preferred due to the resulting number of different possible bets or wagers that can be made as well as the actual odds related to the number of times at least statistically the different possible outcomes will occur. In addition, dice other than conventional six sided dice, such as a lesser number of eight sided dice, could also be utilized, although again this would affect the required game table layout and in addition would require changing the number of wagering spots available in the first and second wagering areas in a manner that is generally considered to be less than optimal, in large part because it is less familiar to most players.

The dice game of the invention may also be implemented as a video game or Internet-based game, in which case the game is played via computer or electronic device under software control with the dice, playing surface, and other components of the game being simulated on a video display and with each player participating at an interactive video station or a portable electronic device. The display may depict on the playing surface a single dealer station and either a single or multiple player stations according to the type of game, with the layout of each player station in one embodiment being substantially the same as depicted in the drawing figures. The table game disclosed herein therefore can be played on a gaming machine such as a video machine or in any gaming environment. Therefore, the term "table" as used in the claims is intended to encompass any video game or other dice game that uses the game station layout or method of play of the game of the present invention.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

We claim:

1. A casino table game comprising:

a. a plurality of like dice, each of said dice having a plurality of sides, each of said sides having a unique indicia applied, and each of said unique indicia being assigned a higher or lower game ranking with respect to each other of said unique indicia, said dice being further categorized into a first group comprising all of the dice and a second group comprising those dice in the first group not determined to be "High Roll" dice upon a roll of said first group, the number of said dice in the second group being variable and always numbering less than the number in the first group;

b. a game layout defining a playing surface, said playing surface including one or more player stations, each of said one or more player stations defining a first dice group wagering zone, a first and second dice group wagering zone, and a second roll wagering spot;

c. said first dice group wagering zone containing a plurality of wagering spots equal to the number of sides of said dice, each of said wagering spots containing one of said unique indicia and arranged on the playing surface in a sequence according to the order of ranking of said unique indicia, said first dice group wagering zone for players to place bets on which of the unique indicia on the dice having the highest ranking will land face upwardly the greatest number of times upon a roll of said first group of dice, and, d. said first and second dice group wagering zone including between five and eleven wagering spots, said wagering spots each containing indicia representing a different possible outcome resulting from either a roll of said first group of dice or a roll of both said first and second groups of dice, said first and second dice group wagering zone for players to place bets on the actual number of highest ranking like kind indicia dice that will land facing upwardly from rolling said first group of dice or both said first and second groups of dice;

e. a second roll wagering spot by which when an ante is placed on said second roll wagering spot the player is potentially eligible to win on the outcome of a roll of the first and second groups of dice in said first and second roll wagering zone; and f. a dice throw box provided in said playing surface, said throw box having a floor section including a dice throwing area in which said first and second groups of dice are rolled, said floor section being recessed in an opening in the playing surface for receiving the dice throw box, said throw box positioned such that dice when rolled in the dice throwing area are visible to players positioned at any of the player stations, and a dice sorting area in said floor section adjacent the dice throwing area, said dice throw box additionally comprising a sidewall section extending upwardly from the floor section, and a peripheral rim connected to the sidewall section, said peripheral rim configured to support the dice throw box when mounted in said opening in the playing surface with an underside of the peripheral rim abutting against the playing surface, and a raised dice display area formed in the peripheral rim in which "High Roll" dice removed from play after a roll of said first group of dice are placed, said raised dice display area configured so casino security camera equipment have an unobstructed view of the "High Roll" dice in the display area and to physically separate the "High Roll" dice from other dice in the first group of dice.

2. A casino table game in accordance with claim 1 in which the number of dice is ten.

3. A casino table game in accordance with claim 2 in which the dice are each six-sided dice.

4. A casino table game in accordance with claim 2 additionally comprising a customized payout schedule containing payout values for each wagering spot, and one or more of the payout values being lottery sized payouts having a value of at least two hundred-fifty thousand dollars.

5. A casino table game in accordance with claim 4 additionally comprising at least one token for placement on at least one of said wagering spots.

6. A casino table game in accordance with claim 5 additionally comprising a progressive jackpot feature in which portions of each wager made in the second roll wagering spot are added to a progressive jackpot amount.

7. A casino table game in accordance with claim 5 additionally comprising an illumination means and control system by which the second roll wagering spot is illuminated when a token is placed on said second roll wagering spot, and said second roll wagering spot remains illuminated until the entire round of game play is ended or until game play for the player is determined to be ended.

8. A casino table game in accordance with claim 5 in which the dice sorting area is divided into a plurality of sections each of which a designation of one of the unique indicia on the faces of the dice.

9. A casino table game in accordance with claim 1 additionally comprising another wagering zone including one or more wagering spots one of which contains indicia for a possible outcome in which all of the dice in the first group or both the first and second groups land with the same unique indicia facing upwardly.

10. A casino table game in accordance with claim 9 in which said another wagering zone is a side bet wagering zone.

* * * * *